US005737925A

United States Patent [19]

Sekiya et al.

[11] Patent Number: 5,737,925

[45] Date of Patent: Apr. 14, 1998

[54] FREE PISTON VUILLERMIER MACHINE

[75] Inventors: Hiroshi Sekiya, Ota; Eiji Fukuda, Oizumi-machi, both of Japan

[73] Assignee: Sanyo Electric Co., Ltd., Moriguchi, Japan

[21] Appl. No.: 755,954

[22] Filed: Nov. 25, 1996

[30] Foreign Application Priority Data

| | | | |
|---|---|---|---|
| Nov. 30, 1995 | [JP] | Japan | 7-334315 |
| Nov. 30, 1995 | [JP] | Japan | 7-334316 |
| Nov. 30, 1995 | [JP] | Japan | 7-334317 |
| Nov. 30, 1995 | [JP] | Japan | 7-334332 |

[51] Int. Cl.[6] ..... F25B 9/00

[52] U.S. Cl. ..... 62/6; 60/520

[58] Field of Search ..... 62/6; 60/520

[56] References Cited

U.S. PATENT DOCUMENTS

| | | | |
|---|---|---|---|
| 3,877,239 | 4/1975 | Leo | 62/6 |
| 3,913,339 | 10/1975 | Berry | 62/6 |
| 4,024,727 | 5/1977 | Berry et al. | 62/6 |
| 4,862,695 | 9/1989 | Kushnir | 62/6 |
| 5,615,556 | 4/1997 | Honda et al. | 62/6 |

OTHER PUBLICATIONS

ISEC -91060, pp. 15-20, May 1991, S. Schulz, et al., "Development Of A Free Piston Vuilleumier Machine For Cooling Purposes".

*Primary Examiner*—Christopher Kilner

*Attorney, Agent, or Firm*—Oblon, Spivak, McClelland, Maier & Neustadt, P.C.

[57] ABSTRACT

A free piston Vuillermier machine which is an external combustion heat machine using a regenerative cycle, wherein a low-temperature displacer is made hollow to form a low-temperature displacer gas spring chamber, a low-temperature displacer rod is made hollow to form a hollow chamber for accommodating a high-temperature displacer rod therein as well as a high-temperature displacer gas spring chamber. Further, in the above configuration, a gas spring chamber passage may be formed to make the high-temperature displacer gas spring chamber communicate with the low-temperature displacer gas spring chamber. A high-temperature displacer mechanical spring may be provided in the high-temperature displacer gas spring chamber, and a low-temperature displacer mechanical spring mounted on the low-temperature displacer rod may be provided in the low-temperature displacer gas spring chamber.

11 Claims, 11 Drawing Sheets

FREE PISTON VUILLERMIER MACHINE

BACKGROUND OF THE INVENTION

1. Field of the Invention

The present invention relates to a free piston Vuillermier machine (hereinafter referred to as ("free piston VM machine"), and particularly to a free piston VM machine which is small-sized as a whole so as to be adapted to an air-conditioner, a refrigerator, or the like.

2. Description of the Prior Art

Referring to FIG. 11 which is a view showing the basic configuration of a conventional free piston VM machine, the structure and operation of which will be described below.

In FIG. 11, a high-temperature displacer 101 has a different-stage rod formed by a series-connection of a displacer piston rod 102 having a diameter a and a displacer piston rod 103 having a diameter b. An end portion of the displacer piston rod 103 is forcedly driven up and down in FIG. 11 by a linear actuator 104.

On the other hand, a heat exchanger 106*a* of the high-temperature-side high-temperature portion, a regenerator 107 of the high-temperature-side, a heat exchanger 108 of the high-temperature-side intermediate-temperature portion, a heat exchanger 109 of the low-temperature-side intermediate-temperature portion, a regenerator 110 of the low-temperature-side, and a heat exchanger 111 of the low-temperature-side low-temperature portion are disposed in the outside of cylindrical sleeves 105*a* and 105*b* in the order of descending in FIG. 11. The high-temperature-side intermediate-temperature portion heat exchanger 108 and the low-temperature-side intermediate-temperature portion heat exchanger 109 are united into one part through a ring portion 112.

Further, a cylindrical shell 113 of the high-temperature-side and cylindrical shells 114*a* and 114*b* of the intermediate-temperature-side are disposed in the outside of the high-temperature-side regenerator 107, the high-temperature-side intermediate-temperature portion heat exchanger 108 and the low-temperature-side intermediate-temperature portion heat exchanger 109. Further, a cylindrical shell 115 of the low-temperature-side is disposed in the outside of the low-temperature-side regenerator 110 and the low-temperature-side low-temperature portion heat exchanger 111 so as to be isolated from the outside.

An electric heater 106 is provided on the head of the high-temperature-side cylindrical shell 113 so that heat is extracted from the high-temperature-side intermediate-temperature portion heat exchanger 108 and the low-temperature-side intermediate-temperature portion heat exchanger 109 for the purpose of heating, while heat is given from the low-temperature-side low-temperature portion heat exchanger 111 for the purpose of cooling. As a medium to be carried, water is disposed in the outside of the respective heat exchangers.

Here, a working gas such as helium, or the like, in a high-temperature working space 116 heated by the electric heater 106 and an intermediate-temperature working space 117 heats outside water through the high-temperature-side intermediate-temperature portion heat exchanger 108, while a working gas in a low-temperature working space 118 and an intermediate-temperature working space 117 heats outside water through the low-temperature-side intermediate-temperature portion heat exchanger 109 and takes heat from the outside water through the low-temperature-side low-temperature portion heat exchanger 111. In this occasion, the up-down movement of the high-temperature displacer 101 makes the working gas alternate between the high-temperature working space 116 and the intermediate-temperature working space 117 via the high-temperature-side high-temperature portion heat exchanger 106*a*, the high-temperature-side regenerator 107 and the high-temperature-side intermediate-temperature portion heat exchanger 108.

Further, the up-down movement of a low-temperature displacer 119 makes the working gas alternate between the low-temperature working space 118 and the intermediate-temperature working space 117 via the low-temperature-side low-temperature portion heat exchanger 111, the low-temperature-side regenerator 110 and the low-temperature-side intermediate-temperature portion heat exchanger 109.

In this occasion, a pressure fluctuation of the working gas occurs in the working chamber due to the change of proportion of the high-temperature working gas, the intermediate-temperature working gas and the low-temperature working gas. Further another pressure fluctuation occurs in the gas spring chamber in the low-temperature displacer due to the volumetric change caused by the difference between the diameters a and b of the displacer piston rods 102 and 103 respectively. Thus, exciting force to move the low-temperature displacer 119 is generated due to the difference between the above-mentioned two pressure changes. As a result, the low-temperature displacer 119 operates so that the phase difference between the low-temperature displacer 119 and the high-temperature displacer 101 is kept in a certain constant value. In this occasion, the respective temperatures of the working spaces are kept constant by the heat storage operation of the regenerators 107 and 110. The output of the machine uses the releasing of heat from the respective heat exchangers 108, 109 and 111 for the purpose of heating and the absorption of heat thereto for the purpose of cooling.

Further, the reference numeral 120 designates an auxiliary mechanical spring for the low-temperature displacer; 121, a rod seal for the working space 118; 122, an auxiliary mechanical spring for the high-temperature displacer; 123, a buffer chamber in which the linear actuator and the high-temperature displacer mechanical spring are mounted; and 125, a gas spring chamber for the low-temperature displacer.

Incidentally, because the conventional free piston VM machine is configured in such a manner as described above, the following problems arise.

(1) Because the high-temperature displacer mechanical spring and the linear actuator are provided in the buffer chamber which is in the outside of the machine, the size of the whole VM machine becomes large.

(2) Because the displacer rod passes through the low-temperature chamber, it is necessary to dispose a seal portion but there is a risk of the occurrence of gas leakage or friction loss in this seal portion.

(3) Because the volumes of the gas spring chambers cannot be reduced for the reason of the operating mechanism of the high-temperature and low-temperature displacers, the size of the machine becomes large.

An object of the present invention is to provide a free piston VM machine which is designed to solve the aforementioned problems in the prior art.

SUMMARY OF THE INVENTION

To solve the aforementioned problems, according to a first aspect of the present invention, there is provided a free piston Vuillermier machine which is an external combustion heat machine using a regenerative cycle, wherein a low-temperature displacer is made hollow to form a low-temperature displacer gas spring chamber, and a low-temperature displacer rod is made hollow to form a hollow chamber for accommodating a high-temperature displacer rod therein as well as a high-temperature displacer gas spring chamber.

According to a second aspect of the present invention, preferably, in the above free piston Vuillermier machine of the first aspect, a gas spring chamber passage is formed to make the high-temperature displacer gas spring chamber communicate with the low-temperature displacer gas spring chamber.

According to a third aspect of the present invention, preferably, in the above free piston Vuillermier machine of the first aspect, the high-temperature displacer gas spring chamber includes a high-temperature displacer mechanical spring and the low-temperature displacer gas spring chamber includes a low-temperature displacer mechanical spring mounted on the low-temperature displacer rod.

According to a fourth aspect of the present invention, preferably, in the above free piston Vuillermier machine of the third aspect, a high-temperature gas spring chamber reservoir is externally provided to adjust a volume of the high-temperature displacer gas spring chamber.

According to a fifth aspect of the present invention, preferably, in the above free piston Vuillermier machine of the third aspect, a high-temperature gas spring chamber cylinder and a high-temperature gas spring chamber piston are externally provided to adjust a volume of the high-temperature displacer gas spring chamber, and the high-temperature gas spring chamber piston is driven by an actuator which is constituted by a movable magnet coil and a fixed magnet coil.

According to a sixth aspect of the present invention, preferably, in the above free piston Vuillermier machine of the fifth aspect, an external auxiliary machine driver is additionally provided so as to be interlocked with the actuator.

According to a seventh aspect of the present invention, preferably, in the above free piston Vuillermier machine of the second aspect, the high-temperature displacer gas spring chamber includes a high-temperature displacer mechanical spring whereas the low-temperature displacer gas spring chamber includes a low-temperature displacer mechanical spring mounted on the low-temperature displacer rod.

According to an eighth aspect of the present invention, preferably, in the above free piston Vuillermier machine of the seventh aspect, a high-temperature gas spring chamber reservoir is externally provided to adjust a volume of the high-temperature displacer gas spring chamber.

According to a ninth aspect of the present invention, preferably, in the above free piston Vuillermier machine of the seventh aspect, a high-temperature gas spring chamber cylinder and a high-temperature gas spring chamber piston are externally provided to adjust a volume of the high-temperature displacer gas spring chamber, and the high-temperature gas spring chamber piston is driven by an actuator which is constituted by a movable magnet coil and a fixed magnet coil.

According to a tenth aspect of the present invention, preferably, in the above free piston Vuillermier machine of the ninth aspect, an external auxiliary machine driver is additionally provided so as to be interlocked with the actuator.

Other features and advantages of the present invention will become clear from the following description with reference to the accompanying drawings.

PREFERRED EMBODIMENTS OF THE INVENTION

Various embodiments of the present invention will be described below with reference to FIGS. 1 through 10.

Figure 1:
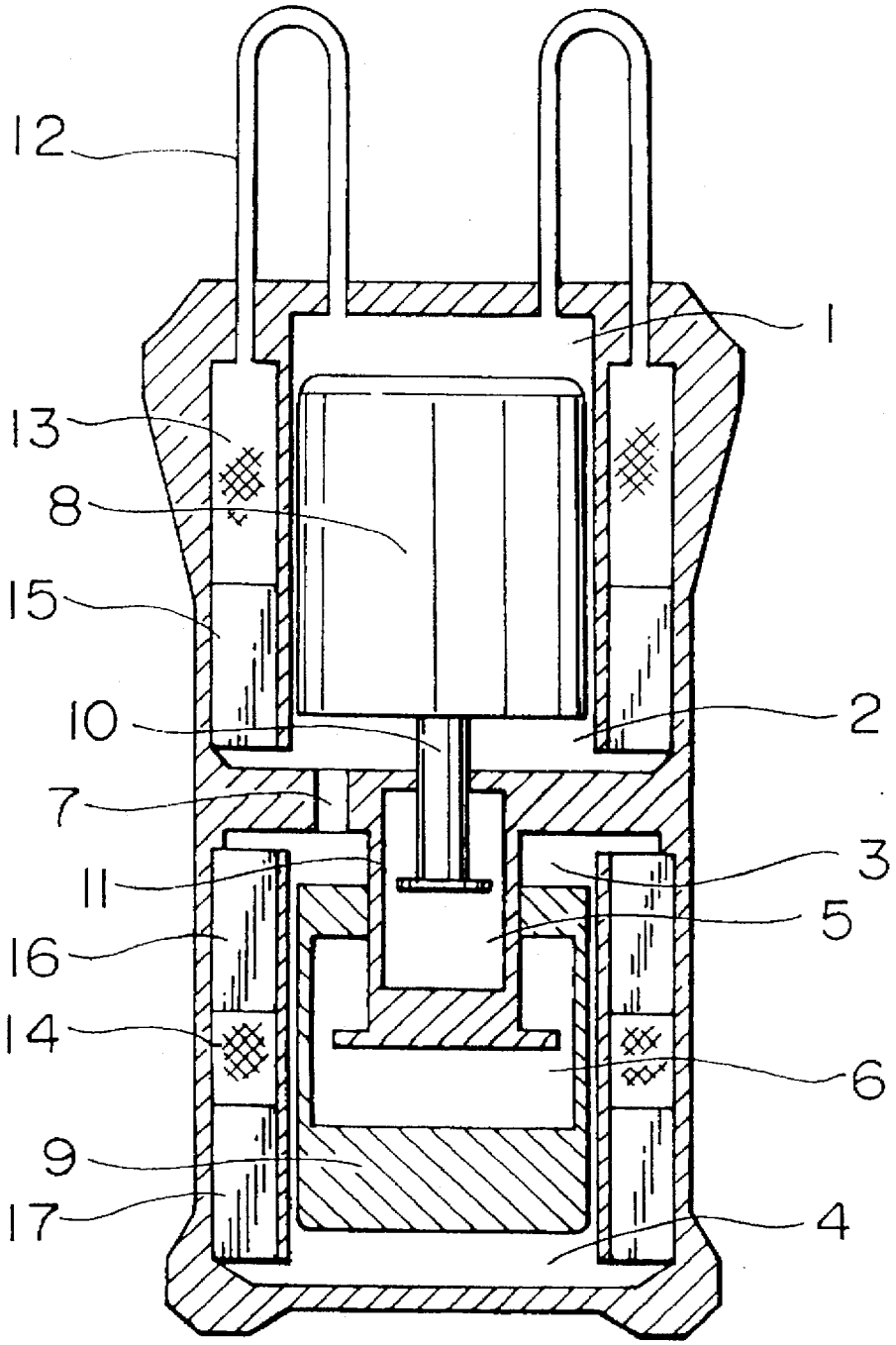
FIG. 1 is a vertical sectional front view showing the configuration of a free piston VM machine which is a first embodiment of the present invention.

Referring now to FIG. 1 which is a vertical sectional front view showing the configuration of a free piston VM machine which is a first embodiment of the present invention, this first embodiment will be described below specifically.

In FIG. 1, the reference numeral 1 designates a high-temperature working space; 2, an intermediate-temperature working space of the high-temperature portion; 3, an intermediate-temperature working space of the low-temperature portion; 4, a low-temperature working space; 5, a gas spring chamber of the high-temperature displacer; 6, a gas spring chamber of the low-temperature displacer; 7, a gas passage for making the high-temperature portion intermediate-temperature working space 2 communicate with the low-temperature portion intermediate-temperature working space 3; 8, a high-temperature displacer; 9, a low-temperature displacer; 10, a high-temperature displacer rod; 11, a low-temperature displacer rod; 12, a heater; 13, a regenerator of the high-temperature-side; 14, a regenerator of the low-temperature-side; 15, a radiator of the high-temperature portion; 16, a radiator of the low-temperature portion; and 17, a cooler.

According to the first embodiment, as described above, the low-temperature displacer is made hollow to form a low-temperature displacer gas spring chamber, and the low-temperature displacer rod is made hollow to form a hollow chamber for accommodating the high-temperature displacer rod therein as well as a high-temperature displacer gas spring chamber.

By the aforementioned configuration, the following excellent effects are provided.

Because it is not necessary to make a rod pass through a low-temperature working space unlike the conventional case, there is no need of sealing and there is no gas leakage. Accordingly, a thermal loss, a mechanical loss due to friction, etc. are reduced.

Because the configuration is made such that the high-temperature displacer mechanical spring provided in the outside of the conventional VM machine is put in the inside of the low-temperature displacer rod disposed in the inside of the machine according to the present invention, the whole structure of the VM machine is considerably reduced in size. Accordingly, there is obtained a free piston VM machine adapted to an air-conditioner, a refrigerator, or the like.

Figure 2:
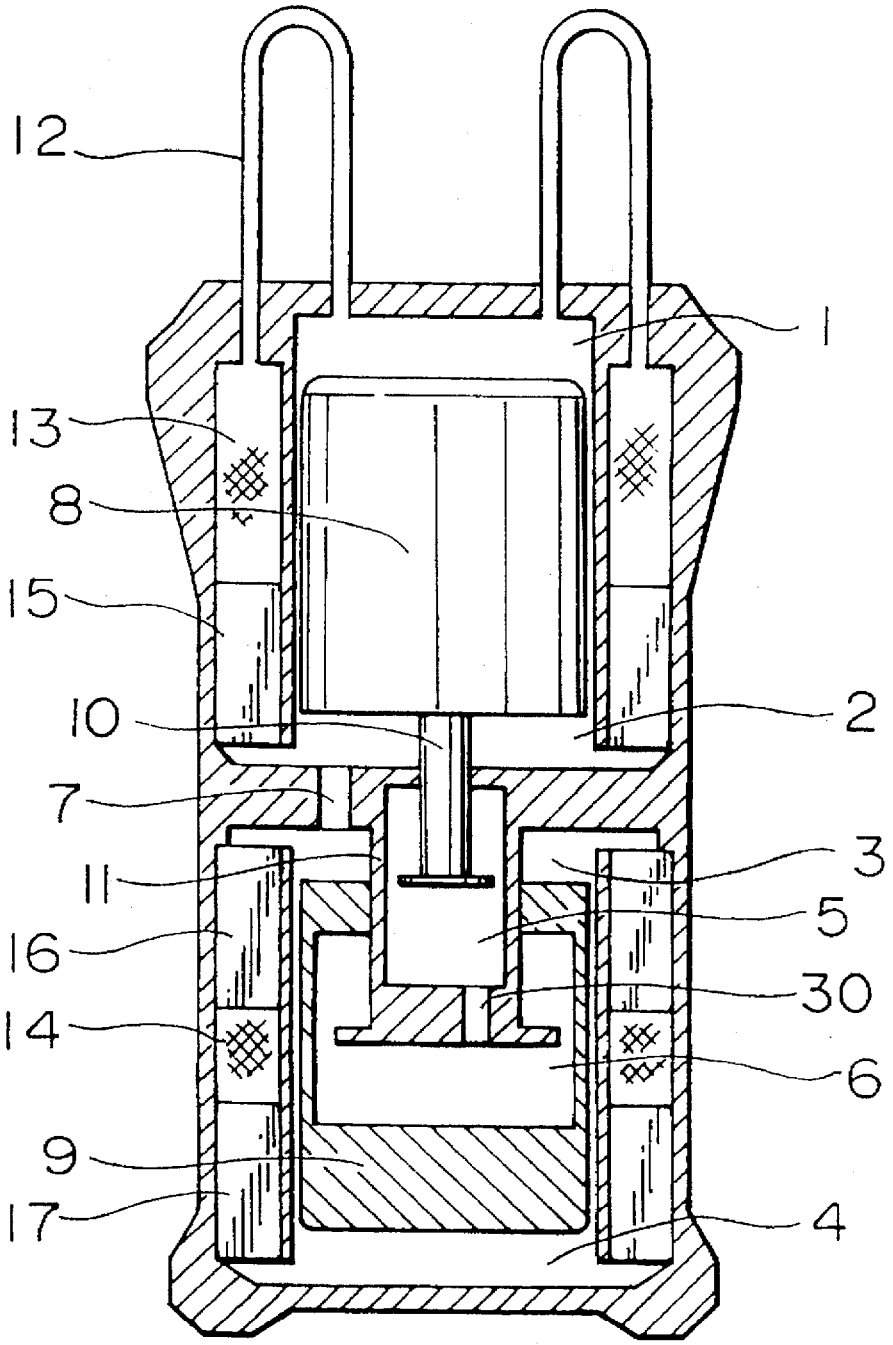
FIG. 2 is a vertical sectional front view showing the configuration of a free piston VM machine which is a second embodiment of the present invention.

Referring now to FIG. 2 which is a vertical sectional front view showing the configuration of a free piston VM machine which is a second embodiment of the present invention, this embodiment will be described below. In FIG. 2, constituent parts identical with or corresponding to those in the first embodiment of FIG. 1 are referenced correspondingly and the description of the same function/operation as that in the first embodiment will be omitted.

The second embodiment is different from the first embodiment in that a gas spring chamber passage 30 is provided to make the high-temperature displacer gas spring chamber 5 communicate with the low-temperature displacer gas spring chamber 6. Because the gas spring chamber passage 30 is provided to make the high-temperature displacer gas spring chamber 5 communicate with the low-temperature displacer gas spring chamber 6 as described above, the volume of the high-temperature displacer gas spring chamber 5 required for the gas spring operation generated in the chamber 5 by the up-down movement of the high-temperature displacer rod 10 can be reduced so that the VM machine can be designed to be compact.

Figure 3:
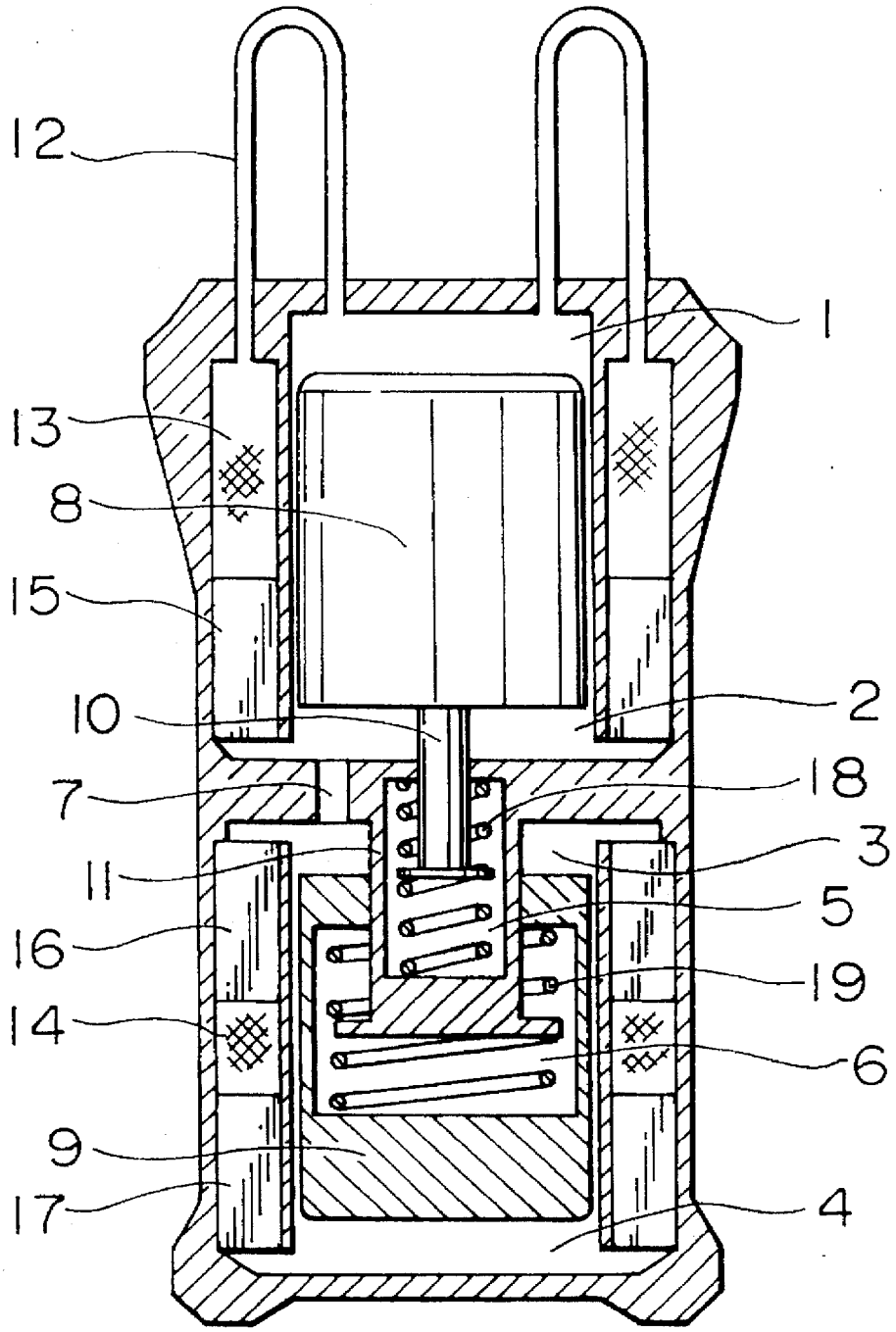
FIG. 3 is a vertical sectional front view showing the configuration of a free piston VM machine which is a third embodiment of the present invention.

Referring now to FIG. 3 which is a vertical sectional front view showing the configuration of a free piston VM machine which is a third embodiment of the present invention, this third embodiment will be described below. In FIG. 3, constituent parts identical with or corresponding to those in the first embodiment of FIG. 1 are referenced correspondingly and the description of the same function/operation as that in the first embodiment will be omitted.

The third embodiment is different from the first embodiment in that a mechanical spring 18 of the high-temperature displacer is provided in the gas spring chamber of the high-temperature displacer and a mechanical spring 19 of the low-temperature displacer to be mounted on the low-temperature displacer rod is provided in the gas spring chamber of the low-temperature displacer.

By the aforementioned configuration, the following excellent effects are provided.

Because it is not necessary to make a rod pass through a low-temperature working space unlike the conventional case, there is no need of sealing and there is no gas leakage. Accordingly, a thermal loss, a mechanical loss due to friction, etc. are reduced.

Because the configuration is made such that the high-temperature displacer mechanical spring provided in the outside of the conventional VM machine is put in the inside of the low-temperature displacer rod disposed in the inside of the machine according to the present invention, the whole structure of the VM machine is considerably reduced in size. Accordingly, there is obtained a free piston VM machine adapted to an air-conditioner, a refrigerator, or the like.

Respective gas springs and mechanical springs on the high-temperature side and on the low-temperature side can be designed to have proper values independently.

Figure 4:
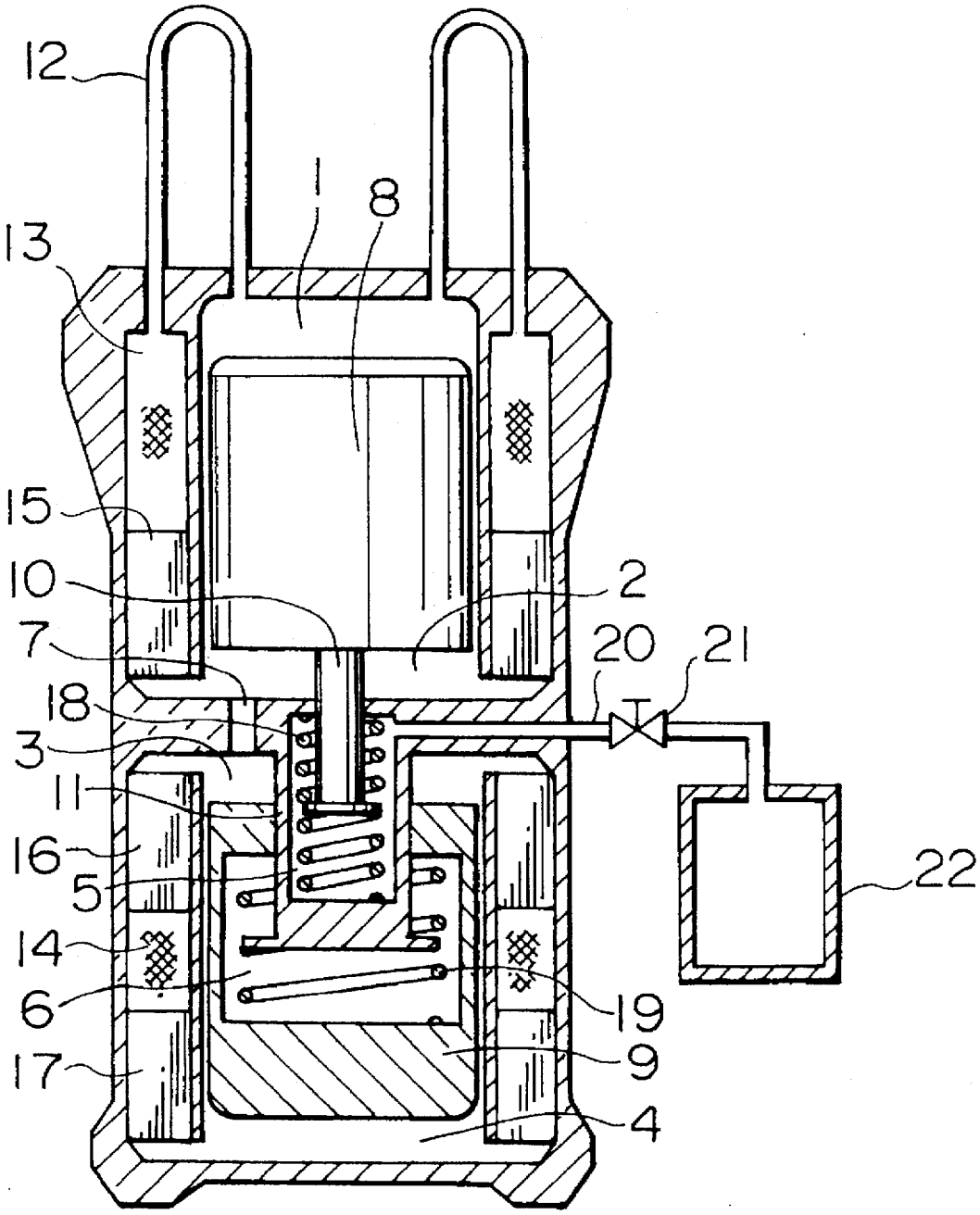
FIG. 4 is a vertical sectional front view showing the configuration of a free piston VM machine which is a fourth embodiment of the present invention.

Referring to FIG. 4 which is a vertical sectional front view showing the configuration of a free piston VM machine which is a fourth embodiment of the present invention, this fourth embodiment will be described below. In FIG. 4, constituent parts identical with or corresponding to those in the third embodiment of FIG. 3 are referenced correspondingly and the description of the same function/operation as that in the third embodiment will be omitted.

In FIG. 4, the reference numeral 22 designates a reservoir of the high-temperature gas spring chamber; 20, a reservoir gas passage; and 21, a flow regulating valve.

The fourth embodiment has a constituent feature in that, in addition to the third embodiment, the high-temperature gas spring chamber reservoir 22 is provided in the outside of the machine so as to communicate with the high-temperature displacer gas spring chamber 5 through the gas passage 20 and the flow regulating valve 21.

In the fourth embodiment, as described above, particularly because the gas spring chamber reservoir 22 communicating with the high-temperature displacer gas spring chamber 5 is provided in the outside, the size of the high-temperature displacer gas spring chamber 5 provided in the inside of the machine is reduced correspondingly so that the whole machine is made compact.

Incidentally, gas supplied to the high-temperature gas spring reservoir 22 can be regulated to a desired value by the flow regulating valve 21.

Because it is not necessary to make a rod pass through a low-temperature working space unlike the conventional case, there is no need of sealing and there is no gas leakage. Accordingly, a thermal loss, a mechanical loss due to friction, etc. are reduced. Further, because this embodiment is designed so that the high-temperature displacer mechanical spring provided in the outside of the conventional VM machine is accommodated in the inside of the low-temperature displacer rod disposed in the inside of the machine, the whole structure of the VM machine can be reduced in size from this point of view.

Figure 5:
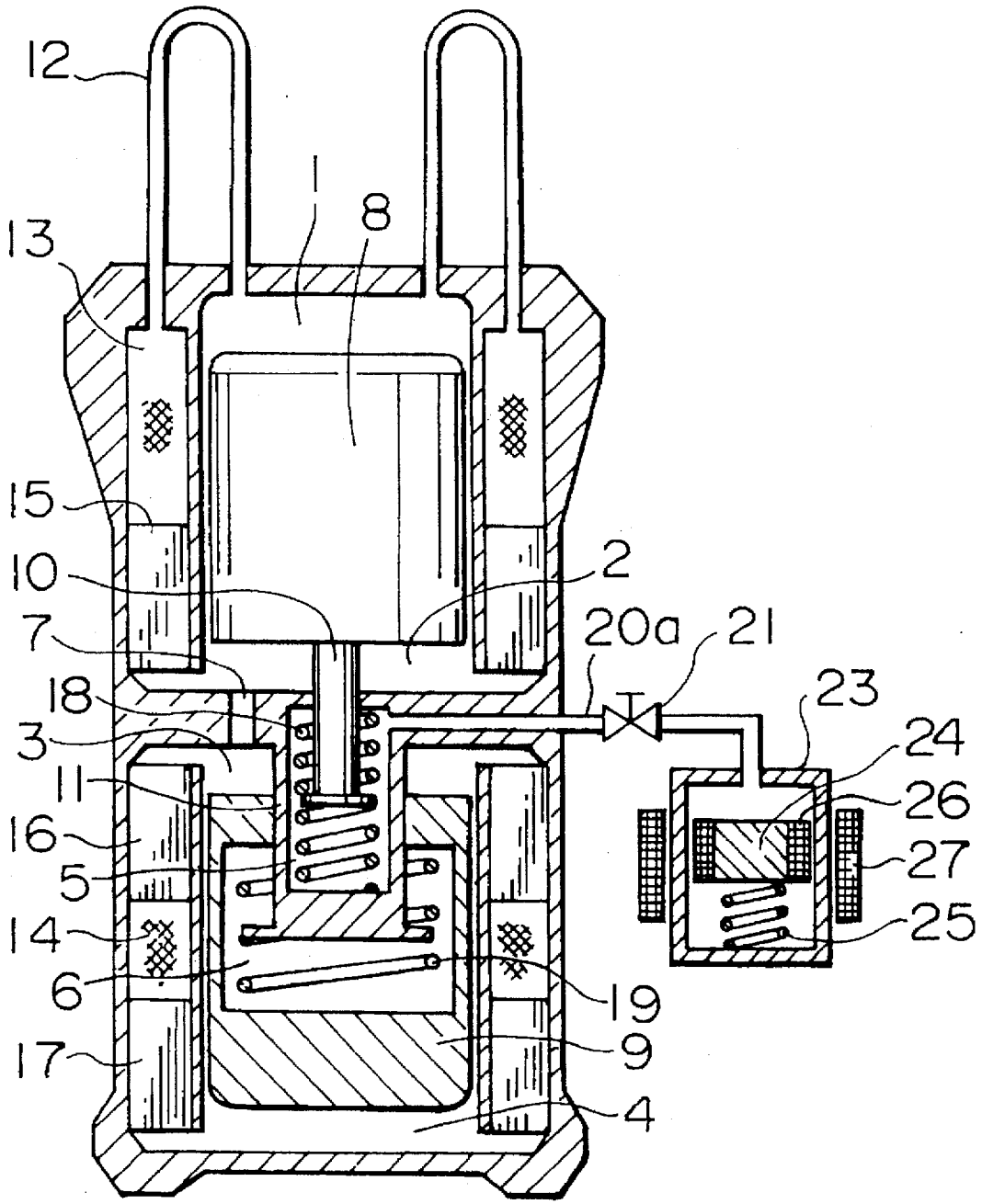
FIG. 5 is a vertical sectional front view showing the configuration of a free piston VM machine which is a fifth embodiment of the present invention.

Referring to FIG. 5 which is a vertical sectional front view showing the configuration of a free piston VM machine which is a fifth embodiment of the present invention, this fifth embodiment will be described below. In FIG. 5, constituent parts identical with or corresponding to those in the third embodiment of FIG. 3 are referenced correspondingly and the description of the same function/operation as that in the third embodiment will be omitted.

As shown in FIG. 5, the fifth embodiment has a constitutional feature in that a high-temperature displacer gas spring chamber volume adjusting means constituted by a high-temperature gas spring chamber cylinder 23, a piston 24 included in the cylinder 23, a piston retaining spring 25, a movable magnet coil 26 and a fixed magnet coil 27 is connected, in place of the high-temperature gas spring chamber reservoir 22 in the fourth embodiment, to a cylinder gas passage 20*a* through the flow regulating valve 21.

In the fifth embodiment, because the adjustment by the volume adjusting means for the high-temperature displacer gas spring chamber is performed by driving the high-temperature gas spring chamber piston by means of an actuator which is constituted by a movable magnet coil and a fixed magnet coil, the size of the high-temperature gas spring chamber cylinder can be reduced compared with the high-temperature gas spring chamber reservoir in the fourth embodiment in which the volume is fixed.

Incidentally, gas supplied to the high-temperature gas spring chamber cylinder 23 can be regulated to a desired value by the flow regulating valve 21.

Further, this embodiment is the same as the third embodiment in that there is no need for sealing, there is no gas leakage and, accordingly, a thermal loss, a mechanical loss due to friction, or the like, are reduced.

Figure 6:
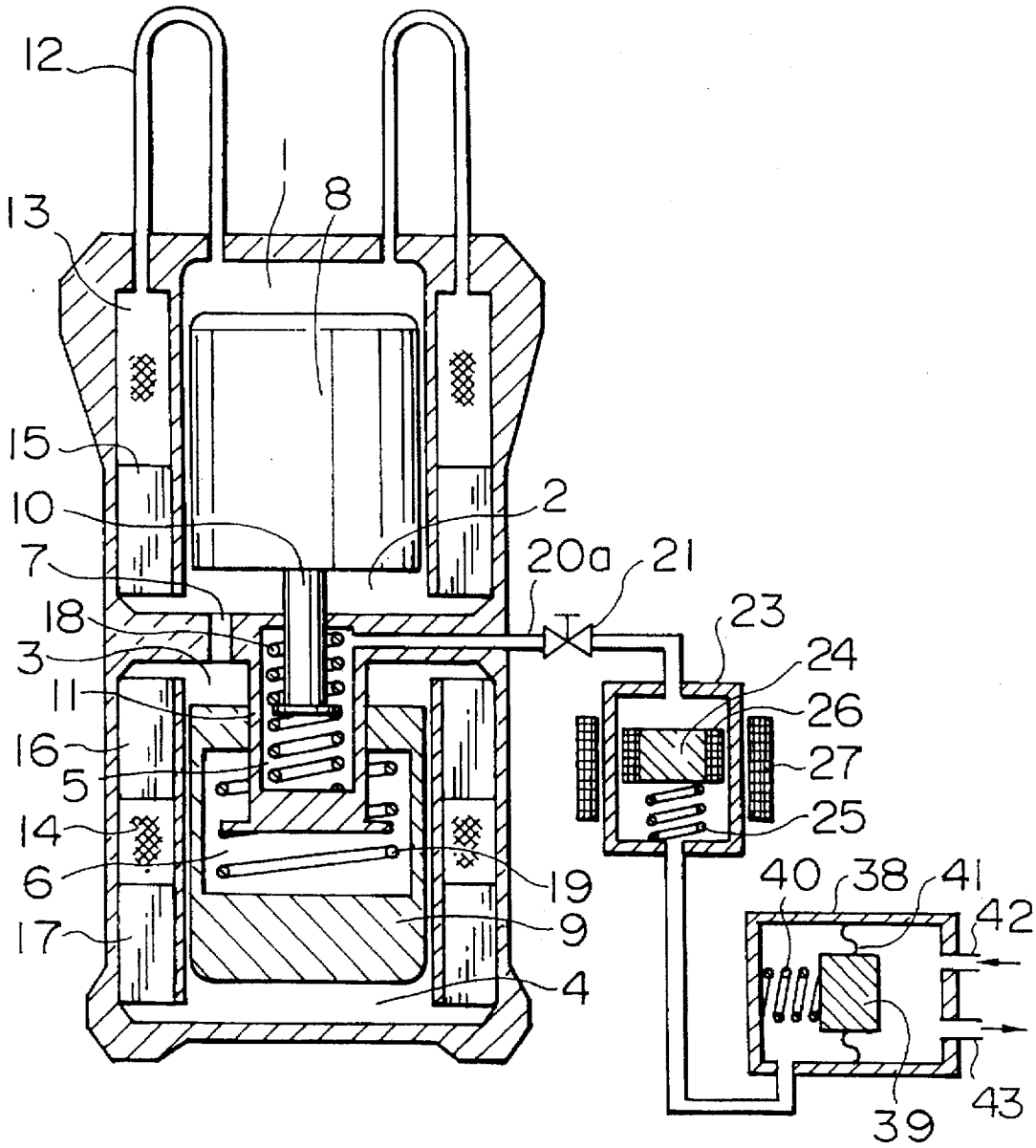
FIG. 6 is a vertical sectional front view showing the configuration of a free piston VM machine which is a sixth embodiment of the present invention.

Referring to FIG. 6 which is a vertical sectional front view showing the configuration of a free piston VM machine which is a sixth embodiment of the present invention, this sixth embodiment will be described below. In FIG. 6, constituent parts identical with or corresponding to those in the fifth embodiment of FIG. 5 are referenced correspondingly and the description of the same function/operation as that in the fifth embodiment will be omitted.

As shown in FIG. 6, the sixth embodiment is obtained by providing an external auxiliary machine driver interlocked with the aforementioned actuator in addition to the configuration of the fifth embodiment. Incidentally, the external auxiliary machine driver can be used for an air blower, a water pump, etc. As shown in FIG. 6, the external auxiliary machine driver is constituted by an auxiliary machine cylinder 38, an auxiliary machine piston 39, a piston retaining spring 40, a diaphragm 41, an inlet port 42 and an outlet port 43. If necessary, a crank mechanism may be added to the auxiliary machine piston 39.

By the presence of the auxiliary machine such as an auxiliary machine cylinder, or the like, which is provided so as to be interlocked with the actuator of the high-temperature gas spring chamber cylinder, the external auxiliary machine which is generally provided separately from the VM machine becomes unnecessary.

Incidentally, also this embodiment is the same as the fifth embodiment in that gas supplied to the high-temperature gas spring chamber cylinder 23 can be regulated to a desired value by the flow regulating valve 21 and is the same as the fourth embodiment in that there is no need for sealing and there is no gas leakage so that a thermal loss, a mechanical loss due to friction, etc. are reduced.

Figure 7:
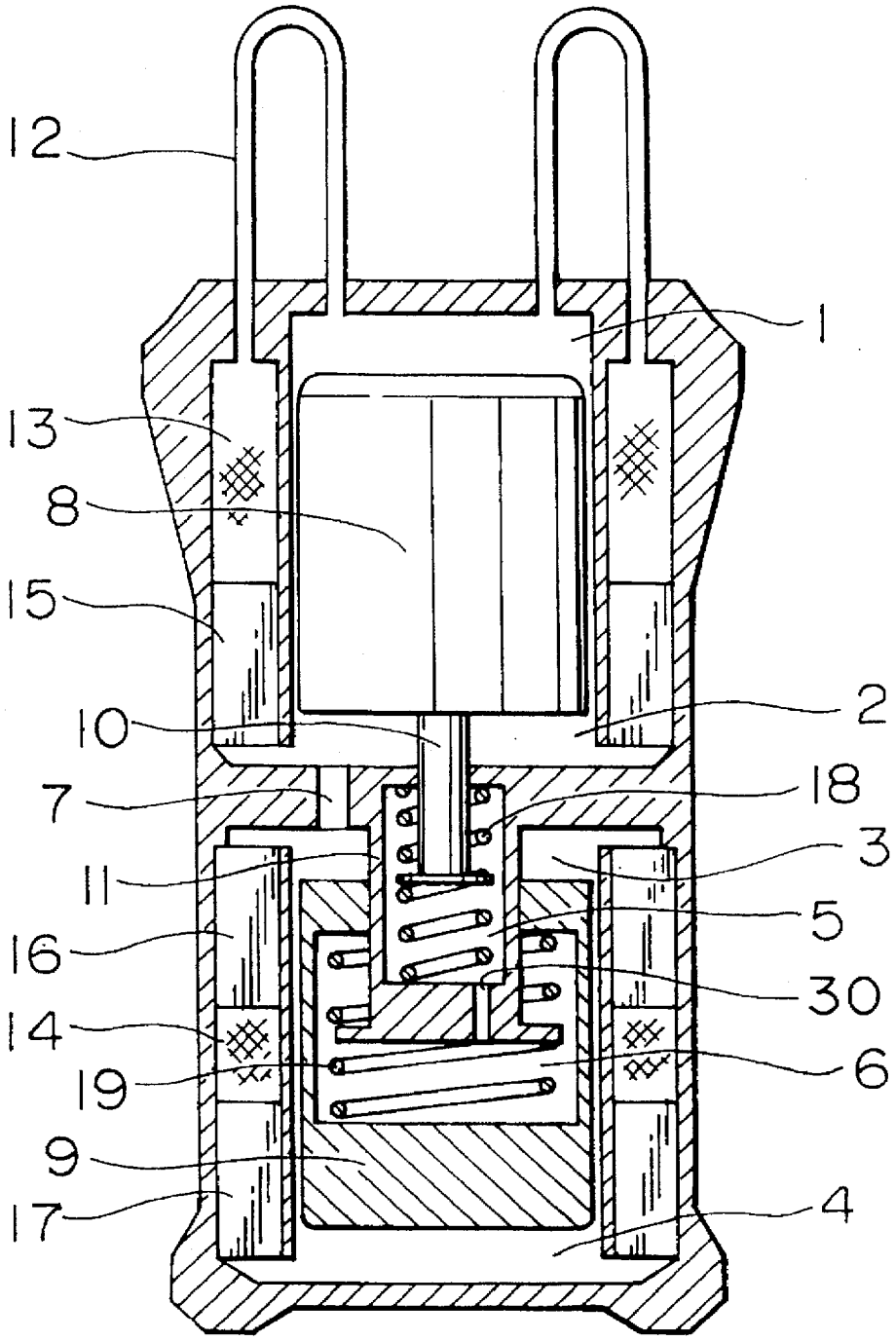
FIG. 7 is a vertical sectional front view showing the configuration of a free piston VM machine which is a seventh embodiment of the present invention.

Referring now to FIG. 7 which is a vertical sectional front view showing the configuration of a free piston VM machine which is a seventh embodiment of the present invention, this seventh embodiment will be described below. In FIG. 7, constituent parts identical with or corresponding to those in the third embodiment of FIG. 3 are referenced correspondingly and the description of the same function/operation as that in the third embodiment will be omitted.

The seventh embodiment is different from the third embodiment in that a gas spring chamber passage 30 is provided to make the high-temperature displacer gas spring chamber 5 communicate with the low-temperature displacer gas spring chamber 6. Because the gas spring chamber passage 30 is provided to make the high-temperature displacer gas spring chamber 5 communicate with the low-temperature displacer gas spring chamber 6 as described above, the volume of the high-temperature displacer gas spring chamber 5 required for the gas spring operation generated in the chamber 5 by the up-down movement of the high-temperature displacer rod 10 can be reduced so that the VM machine can be designed to be compact.

According to the seventh embodiment, similarly to the third embodiment, the low-temperature displacer is made hollow to form a low-temperature displacer gas spring chamber, and the low-temperature displacer rod is made hollow to form a hollow chamber for accommodating the high-temperature displacer rod therein as well as a high-temperature displacer gas spring chamber, and, furthermore, a gas spring chamber passage is formed to make the high-temperature displacer gas spring chamber communicate with the low-temperature displacer gas spring chamber. Accordingly, the following excellent effects arise.

Because it is not necessary to make a rod pass through a low-temperature working space unlike the conventional case, there is no need of sealing and there is no gas leakage. Accordingly, a thermal loss, a mechanical loss due to friction, etc. are reduced.

Because the configuration is made such that the high-temperature displacer mechanical spring provided in the outside of the conventional VM machine is accommodated in the inside of the low-temperature displacer rod disposed in the inside of the machine according to the present invention and that the high-temperature displacer gas spring chamber and the low-temperature displacer gas spring chamber are used together with each other, the volume of the high-temperature displacer gas spring chamber can be reduced so that the size of the whole VM machine can be reduced greatly. Accordingly, there is obtained a free piston VM machine adapted to an air-conditioner, a refrigerator, or the like.

Figure 8:
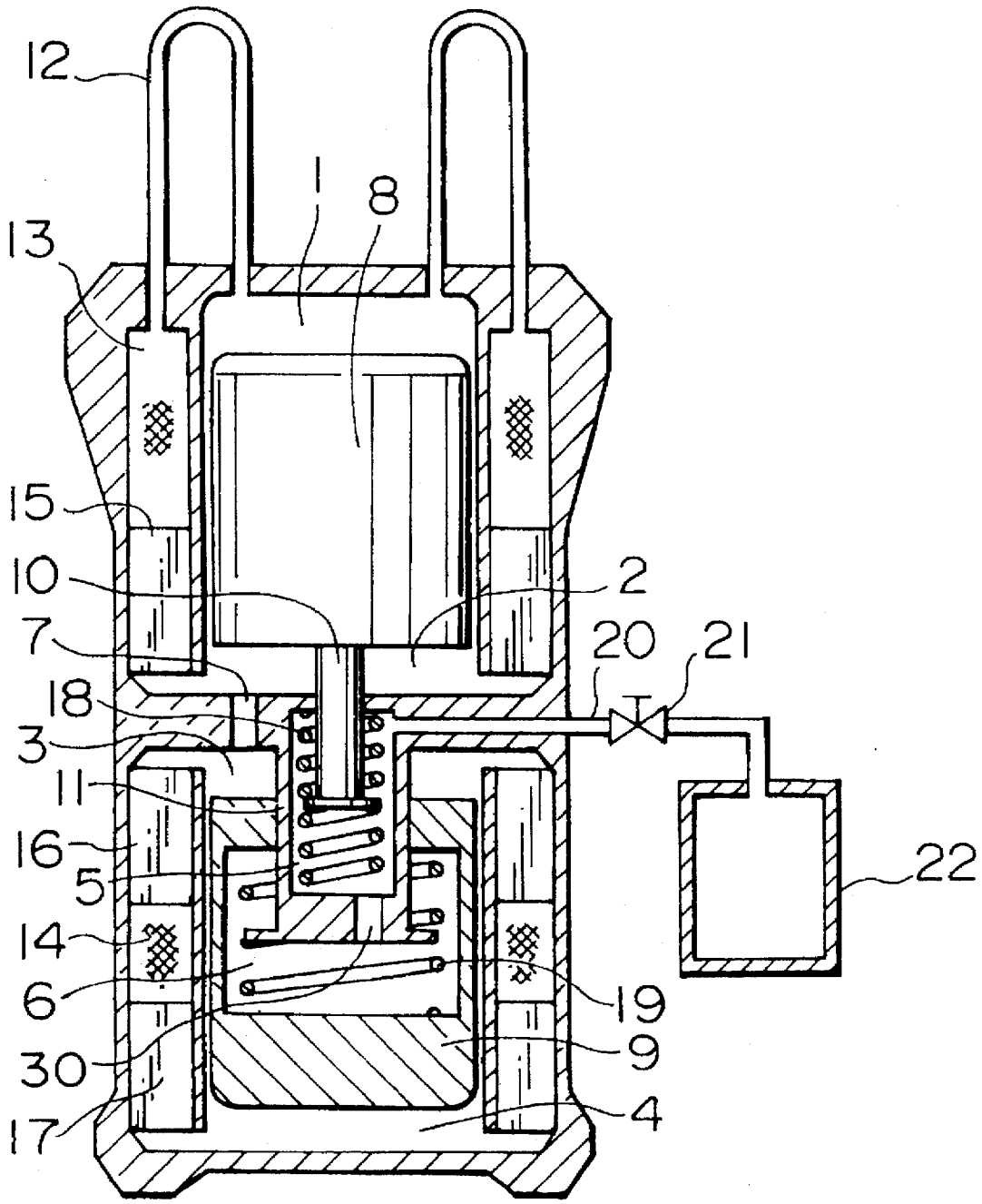
FIG. 8 is a vertical sectional front view showing the configuration of a free piston VM machine which is an eighth embodiment of the present invention.

Referring to FIG. 8 which is a vertical sectional front view showing the configuration of a free piston VM machine which is an eighth embodiment of the present invention, this eighth embodiment will be described below. In FIG. 8, constituent parts identical with or equivalent to those in the seventh embodiment shown in FIG. 7 are referenced correspondingly and the description of the same function/operation as that in the seventh embodiment will be omitted. Incidentally, the reference numeral 22 designates a high-temperature gas spring chamber reservoir; 20, a reservoir gas passage; and 21, a flow regulating valve.

The eighth embodiment is different from the seventh embodiment in that the gas spring chamber reservoir 22 is provided in the outside to adjust both volumes of the high-temperature displacer gas spring chamber 5 and the low-temperature displacer gas spring chamber 6 as described above.

In the eighth embodiment, as described above, the gas spring chamber reservoir 22 is provided in the outside so as to communicate with both the high-temperature displacer gas spring chamber 5 and the low-temperature displacer gas spring chamber 6. Accordingly, the high-temperature displacer gas spring chamber 5 and the low-temperature displacer gas spring chamber 6 both of which are provided in the inside of the machine are reduced in size correspondingly, so that the size of the whole machine can be made compact.

Incidentally, gas supplied to the reservoir 22 can be regulated to a desired value by the flow regulating valve 21.

Further, because it is not necessary to make a rod pass through a low-temperature working space unlike the conventional case, there is no need of sealing and there is no gas leakage. Accordingly, a thermal loss, a mechanical loss due to friction, etc. are reduced. Further, because the configuration is made such that the high-temperature displacer mechanical spring provided in the outside of the conventional VM machine is accommodated in the inside of the low-temperature displacer rod disposed in the inside of the machine, the whole structure of the VM machine can be reduced in size from this point of view.

Figure 9:
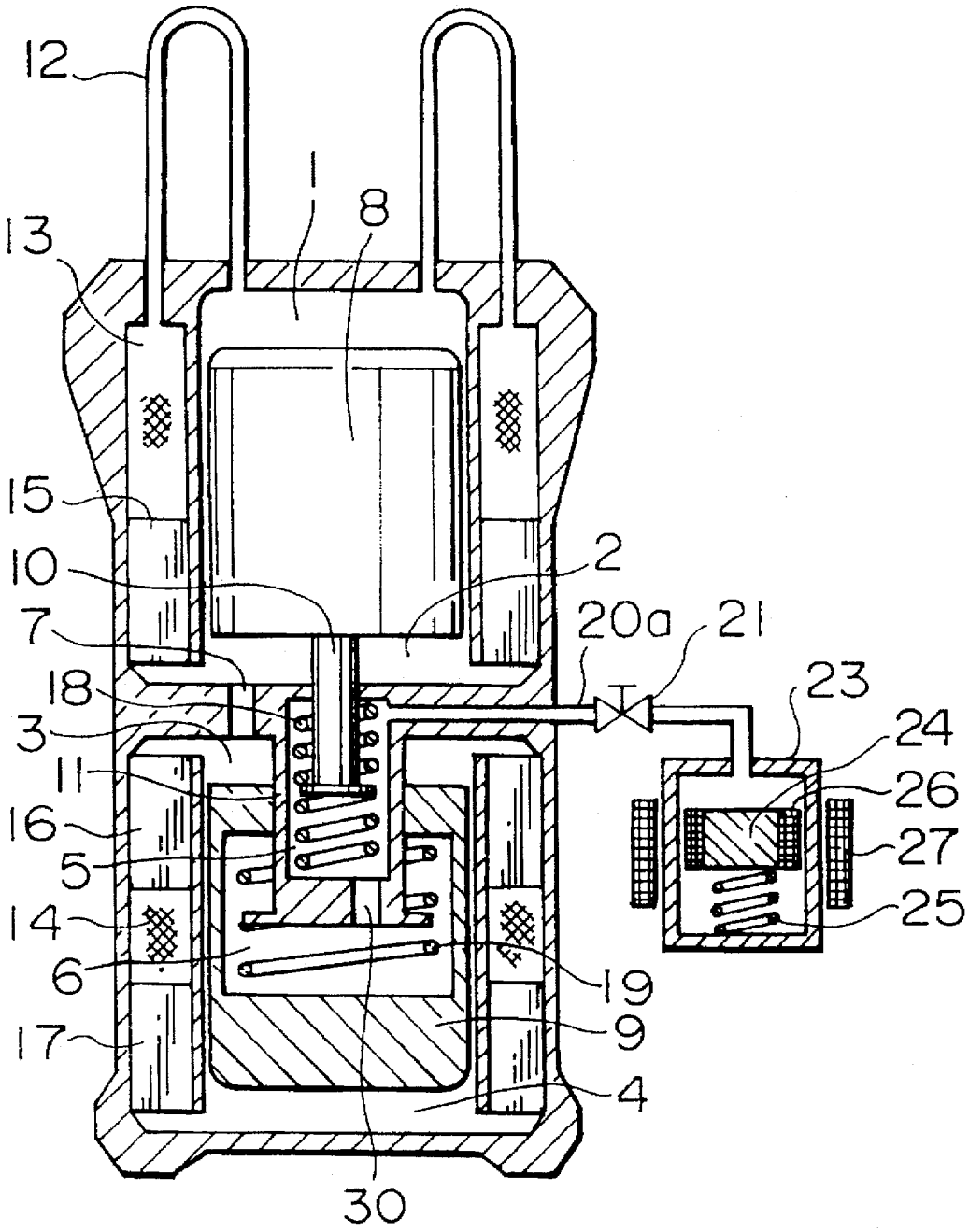
FIG. 9 is a vertical sectional front view showing the configuration of a free piston VM machine which is a ninth embodiment of the present invention.

Referring to FIG. 9 which is a vertical sectional front view showing the configuration of a free piston VM machine which is a ninth embodiment of the present invention, this ninth embodiment will be described below. In FIG. 9, constituent parts identical with or equivalent to those in the eighth embodiment shown in FIG. 8 are referenced correspondingly and the description of the same function/operation as that in the eighth embodiment will be omitted.

The ninth embodiment is a modification of the eighth embodiment. This embodiment is different from the eighth embodiment in that the reservoir 22 for adjusting the volumes of the high-temperature and low-temperature displacer gas spring chambers in the eighth embodiment is replaced by a cylinder 23, a piston 24 included in the cylinder 23, a piston retaining spring 25, a movable magnet coil 26 and a fixed magnet coil 27 as means for adjusting the volumes of the high-temperature and low-temperature displacer gas spring chambers and that the volume adjusting means is connected to a cylinder gas passage 20*a* through a flow regulating valve 21.

In the ninth embodiment, because the adjustment by the volume adjusting means for the high-temperature/low-temperature displacer gas spring chamber is performed by driving the piston by the actuator which is constituted by the movable magnet coil and the fixed magnet coil, the size of the cylinder can be reduced compared with the high-temperature/low-temperature gas spring chamber reservoir in the eighth embodiment of the type in which the volume is a fixed.

Incidentally, gas supplied to the high-temperature/low-temperature gas spring chamber cylinder 23 can be adjusted to a desired value by means of the flow regulating valve 21.

Further, this embodiment is the same as the seventh embodiment in that there is no need for sealing, there is no gas leakage and, accordingly, a thermal loss, a mechanical loss due to friction, or the like, are reduced.

Figure 10:
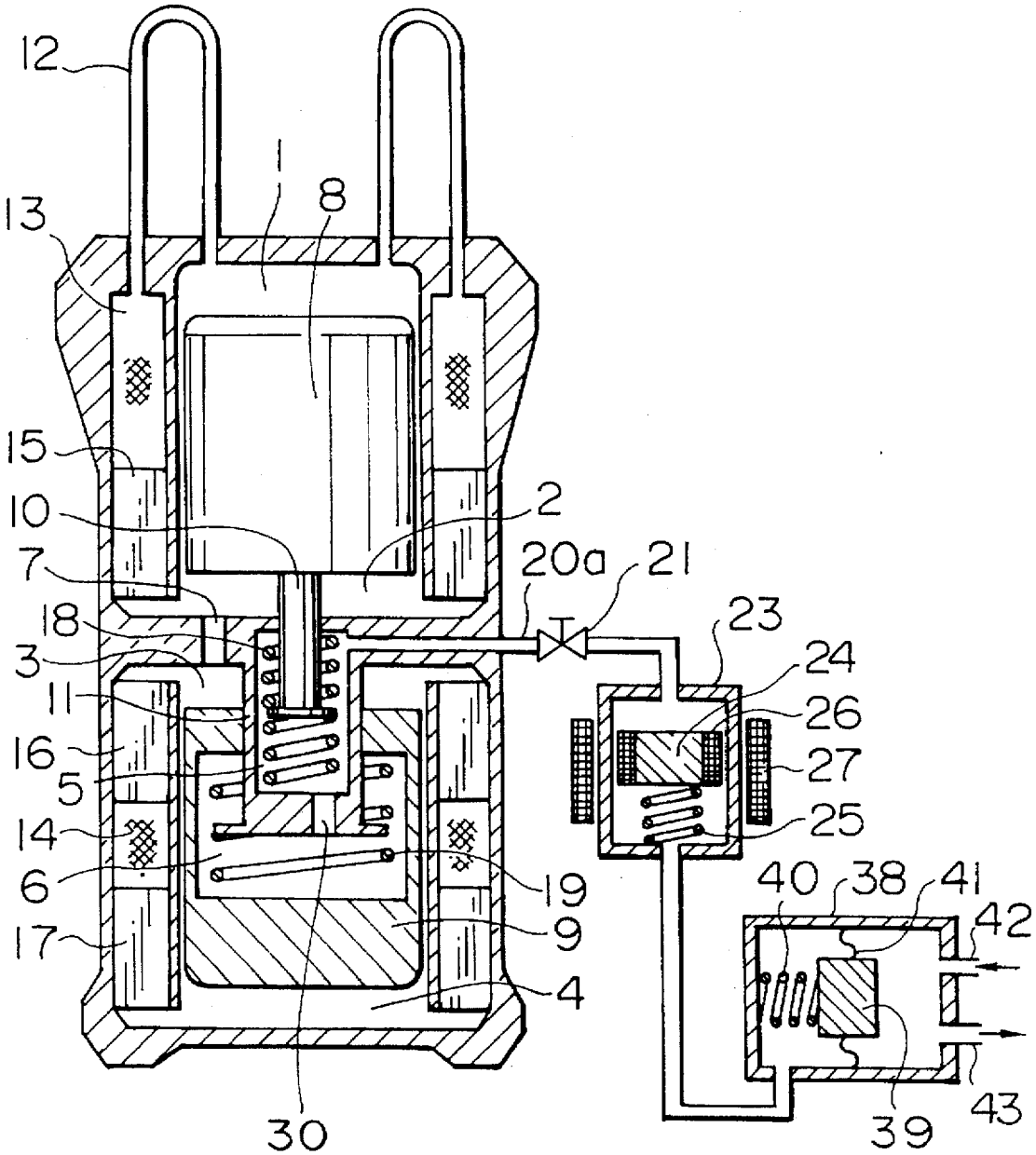
FIG. 10 is a vertical sectional front view showing the configuration of a free piston VM machine which is a tenth embodiment of the present invention.
Figure 11:
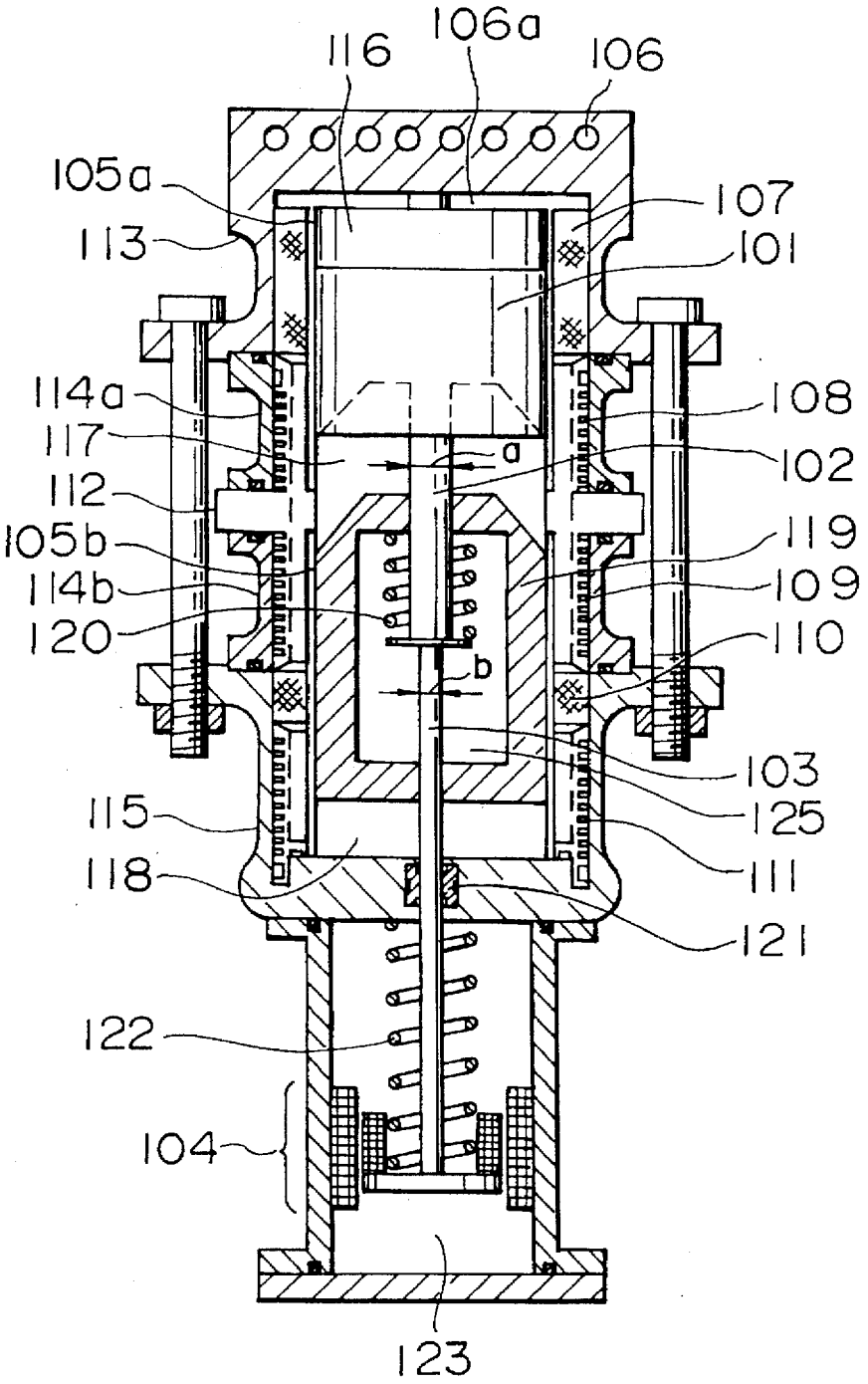
FIG. 11 PRIOR ART
FIG. 11 is a vertical sectional front view showing the configuration of a conventional free piston VM machine.

Referring to FIG. 10 which is a vertical sectional front view showing the configuration of a free piston VM machine which is a tenth embodiment of the present invention, this tenth embodiment will be described below. This tenth embodiment is a modification of the ninth embodiment, and in FIG. 10, constituent parts identical with or corresponding to those in the ninth embodiment of FIG. 9 are referenced correspondingly and the description of the same function/operation as that in the ninth embodiment will be omitted.

The tenth embodiment is different from the ninth embodiment in that an external auxiliary machine driver interlocked with the aforementioned actuator is provided in addition to the configuration of the ninth embodiment. The external auxiliary machine driver can be used for an air blower, a water pump, etc. As shown in FIG. 10, the external auxiliary machine driver is constituted by an auxiliary machine cylinder 38, an auxiliary machine piston 39, a piston retaining spring 40, a diaphragm 41, an inlet port 42 and an outlet port 43. If necessary, a crank mechanism may be added to the auxiliary machine piston 39.

By the presence of the auxiliary machine such as an auxiliary machine cylinder, or the like, which is provided in the tenth embodiment so as to be interlocked with the actuator of the high-temperature/low-temperature gas spring chamber cylinder, the external auxiliary machine which is generally provided separately from the VM machine becomes unnecessary.

Incidentally, also this embodiment is the same as the ninth embodiment in that gas supplied to the high-temperature/low-temperature gas spring chamber cylinder 23 can be regulated to a desired value by the flow regulating valve 21 and is the same as the seventh embodiment in that there is no sealing and there is no gas leakage so that a thermal loss, a mechanical loss due to friction, etc. are reduced.

What is claimed is:

1. A free piston Vuillermier machine which is an external combustion heat machine using a regenerative cycle, wherein a low-temperature displacer is made hollow to form a low-temperature displacer gas spring chamber, a low-temperature displacer rod is made hollow to form a hollow chamber for accommodating therein both a high-temperature displacer rod and a high-temperature displacer gas spring chamber.

2. A free piston Vuillermier machine according to claim 1, wherein a gas spring chamber passage is formed to make said high-temperature displacer gas spring chamber communicate with said low-temperature displacer gas spring chamber.

3. A free piston Vuillermier machine according to claim 1, wherein said high-temperature displacer gas spring chamber includes a high-temperature displacer mechanical spring and said low-temperature displacer gas spring chamber includes a low-temperature displacer mechanical spring mounted on said low-temperature displacer rod.

4. A free piston Vuillermier machine according to claim 3, wherein a high-temperature gas spring chamber reservoir is externally provided to adjust a volume of said high-temperature displacer gas spring chamber.

5. A free piston Vuillermier machine according to claim 3, wherein a high-temperature gas spring chamber cylinder and a high-temperature gas spring chamber piston are externally provided to adjust a volume of said high-temperature displacer gas spring chamber, and said high-temperature gas spring chamber piston is driven by an actuator which is constituted by a movable magnet coil and a fixed magnet coil.

6. A free piston Vuillermier machine according to claim 5, wherein an external auxiliary machine driver is additionally provided so as to be interlocked with said actuator.

7. A free piston Vuillermier machine according to claim 2, wherein said high-temperature displacer gas spring chamber includes a high-temperature displacer mechanical spring whereas said low-temperature displacer gas spring chamber includes a low-temperature displacer mechanical spring mounted on said low-temperature displacer rod.

8. A free piston Vuillermier machine according to claim 7, wherein a high-temperature gas spring chamber reservoir is externally provided to adjust a volume of said high-temperature displacer gas spring chamber.

9. A free piston Vuillermier machine according to claim 7, wherein a high-temperature gas spring chamber cylinder and a high-temperature gas spring chamber piston are externally provided to adjust a volume of said high-temperature displacer gas spring chamber, and said high-temperature gas spring chamber piston is driven by an actuator which is constituted by a movable magnet coil and a fixed magnet coil.

10. A free piston Vuillermier machine according to claim 9, wherein an external auxiliary machine driver is additionally provided so as to be interlocked with said actuator.

11. A free piston vuillermier machine according to claim 1, wherein said low-temperature displacer gas spring chamber is separate from said high-temperature displacer gas spring chamber.

* * * * *